US006390650B1

(12) United States Patent
Brandt et al.

(10) Patent No.: US 6,390,650 B1
(45) **Date of Patent: *May 21, 2002**

(54) SCREENPRINTED UNIFORMITY FILTER FOR LARGE AREA PULSE SOLAR SIMULATOR

(75) Inventors: Randolph Jay Brandt, Palmdale; William Odell Montjar, Castaic, both of CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/386,771

(22) Filed: Aug. 31, 1999

(51) Int. Cl.[7] ..... F21V 9/00
(52) U.S. Cl. ..... 362/293; 362/279; 362/354
(58) Field of Search ..... 362/16, 257, 293, 362/279, 220, 354, 355, 358, 360, 367; 359/885

(56) References Cited

U.S. PATENT DOCUMENTS 4,688,156 A * 8/1987 Suzuki et al. ..... 362/354
6,076,942 A * 6/2000 Brandt ..... 362/279

* cited by examiner

*Primary Examiner*—Sandra O'Shea
*Assistant Examiner*—John Anthony Ward
(74) *Attorney, Agent, or Firm*—Gates & Cooper LLP

(57) ABSTRACT

An apparatus and method for providing uniform intensity light is disclosed. The apparatus comprises a transparent sheet, substantially transparent at a wavelength region of interest, and a line pattern, printed on a first side of the transparent sheet. The line pattern selectively blocks a portion of light transmitted through the transparent sheet, creating a substantially uniform light intensity for the transmitted light.

16 Claims, 6 Drawing Sheets

SCREENPRINTED UNIFORMITY FILTER FOR LARGE AREA PULSE SOLAR SIMULATOR

BACKGROUND OF THE INVENTION

1. Field of the Invention

The present invention relates to solar panel testing, and in particular to an apparatus for providing uniform light intensity during solar panel testing.

2. Description of the Related Art

Spacecraft use solar panels to provide electrical power for spacecraft operation and the charging of batteries. A solar panel is made from a number of individual photovoltaic cells, which produce electrical current in response to solar energy. Reliability in the testing of solar panels is very important to both solar panel manufacturing and spacecraft operation.

Currently, solar panel reliability and performance are characterized using a test configuration such as a large area pulse solar simulator (LAPSS). Often, there is a fine line between acceptable and unacceptable panels. Therefore, tests used to characterize cell performance must be precise and consistent. Precision and consistency are the keys for determining manufacturing yield and field reliability of the solar panels. Manufacturing yield refers to the number of tested and acceptable solar panels that were produced in a production run of a large number of solar panels. Additionally, correlation and repeatability between test results of different test configurations is desirable, i.e., if a particular solar panel fails in a first test configuration, that panel should also fail in a second test configuration.

Advances in solar panel and solar cell technology have yielded larger and more efficient solar panels. Typically, solar panels have fifty or more circuits, and the position of the circuit on the panel should not affect the power generated by the circuit. These advances make precision and consistency in product testing even more important because a small difference in light intensity can yield a significant difference in current produced by the solar panel.

A test configuration such as a LAPSS system uses light sources, such as xenon flash tubes, a series of baffles, and a test bed for measuring the performance of a solar panel. When the light sources illuminate the solar panel, the test bed reads the voltages and currents produced by the panel. A uniform light source is required to prevent cell "hot spots" where light intensity is non-uniformly high and "cold spots" where light intensity is non-uniformly low. Hot spots occur on the panel on the portion of the solar panel that is directly aligned with the light source. Conversely, cold spots occur on the portion of the solar panel that is near the fringe of the light source. Hot spots and cold spots make accurate and repeatable measurements difficult due to the non-uniform illumination of the solar panel. Currently, light sources, such as those used in a LAPSS system, provide reasonably uniform light intensity, but do not take any measures to provide uniform light intensity. Additionally, as solar panel sizes and efficiency increase, current test configurations are unable to illuminate the solar panel with the required light uniformity, thereby magnifying the problems of test reliability and repeatability. Many test configurations require a large panel under test to be moved many times during testing to illuminate sections of the panel with a reasonably uniform light source. The requirement of moving a panel under test limits test accuracy and repeatability, which increases manufacturing cost and time.

It can be seen that there is a need in the art for a highly uniform light intensity testing device. It can also be seen that there is a need in the art for a light intensity device having increased reliability and repeatability of test results, thereby accurately predicting the field reliability of solar panels. It can also be seen that there is a need in the art for a device that decreases the manufacturing cost and time to produce solar panels.

SUMMARY OF THE INVENTION

To address the requirements described above, the present invention discloses a method and apparatus for filtering light to provide a uniform light density at the device under test. An apparatus in accordance with the present invention comprises a transparent sheet, substantially transparent at a wavelength region of interest, and a line pattern, printed on a first side of the transparent sheet. The line pattern selectively blocks a portion of light transmitted through the glass sheet to create a substantially uniform light intensity for the transmitted light.

An object of the present invention is to provide a highly uniform light intensity testing device. Another object of the present invention is to provide a light intensity device having increased reliability and repeatability of test results, thereby accurately predicting the field reliability of solar panels. Another object of the present invention is to provide a device that decreases the manufacturing cost and time to produce solar panels.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description, reference is made to the accompanying drawings which form a part hereof, and which is shown, by way of illustration, several embodiments of the present invention. It is understood that other embodiments may be utilized and structural changes may be made without departing from the scope of the present invention.

Overview

The present invention is a neutral density filter that has multiple zones specifically tailored to offset the uniformity variations present in the LAPSS. Each zone is designed to provide a different degree of light reduction. The pattern image is screenprinted to glass and placed between the light source and the test plane. The pattern of these zones provides a significant increase in light intensity uniformity at the test plane.

The filter of the present invention produces similar favorable results as the previously manufactured filter described in application Ser. No. 09/107,786, filed on Jun. 30, 1998, which is herein incorporated by reference, but the present invention is easier to manufacture. The previous filter was manufactured using hundreds of hand-laid horizontal wires soldered to diagonal support wires which makes the previous filter difficult to produce. The filter of the present invention uses horizontal opaque lines that are screen-printed on glass instead of the wires. This new design uses a repeatable, cost-effective process to manufacture quality filters.

The present invention provides increased performance over the related art due to reduction of variables in the manufacturing process. Further, the present invention reduces risks in handling damage of the filter because the filter of the present invention has no exposed parts or wires as those of the related art. The filter of the present invention is less expensive to produce, and can be produced in less time than the filters of the related art. The filter of the present invention is also adaptable to various testing configurations, which increases the flexibility of the test equipment that uses the filter of the present invention.

Test System

Figure 1:
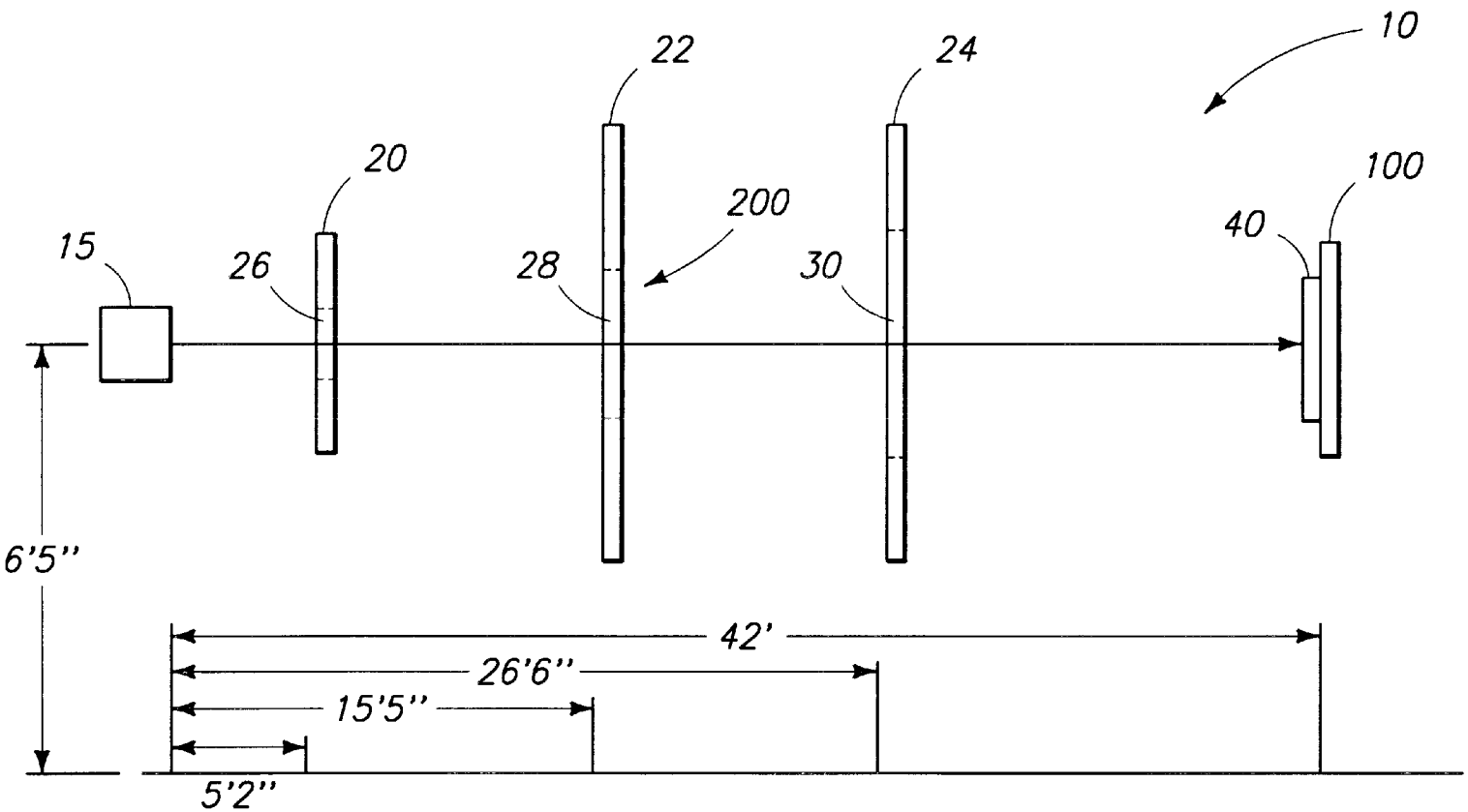
FIG. 1 illustrates the test system that uses the filter of the present invention.

FIG. 1 illustrates the test system that uses the filter of the present invention. The test system 10 uses a flash lamp 15, baffles 20, 22, and 24 having apertures 26, 28, and 30, to allow light from the flash lamp 15 to pass through to a test plane 100 holding a solar panel under test 40. As the solar panel under test 40 is illuminated by the flash lamp 15, the outputs of the solar panel under test 40 are measured. A uniformity filter 200 of the present invention is installed in the aperture 28 of the second baffle 22. The size of the filter 200 and the aperture 28 of the second baffle 22 is preferably six feet by six feet square, but can be other sizes. Further, the filter 200 can be placed at other positions between the flash lamp 15 and the solar panel under test 40.

Filters and apertures of other physical dimensions and forms may be used. For example, baffles 20, 22, and 24 may have circular apertures, and filter 200 can be a circular filter fitted to one of the apertures. The system 10 may also have more or fewer baffles than the three baffles 20, 22, and 24 disclosed in FIG. 1.

Further, multiple filters 200 can be used to provide an even greater degree of uniformity.

Experimental Results

Figure 2:
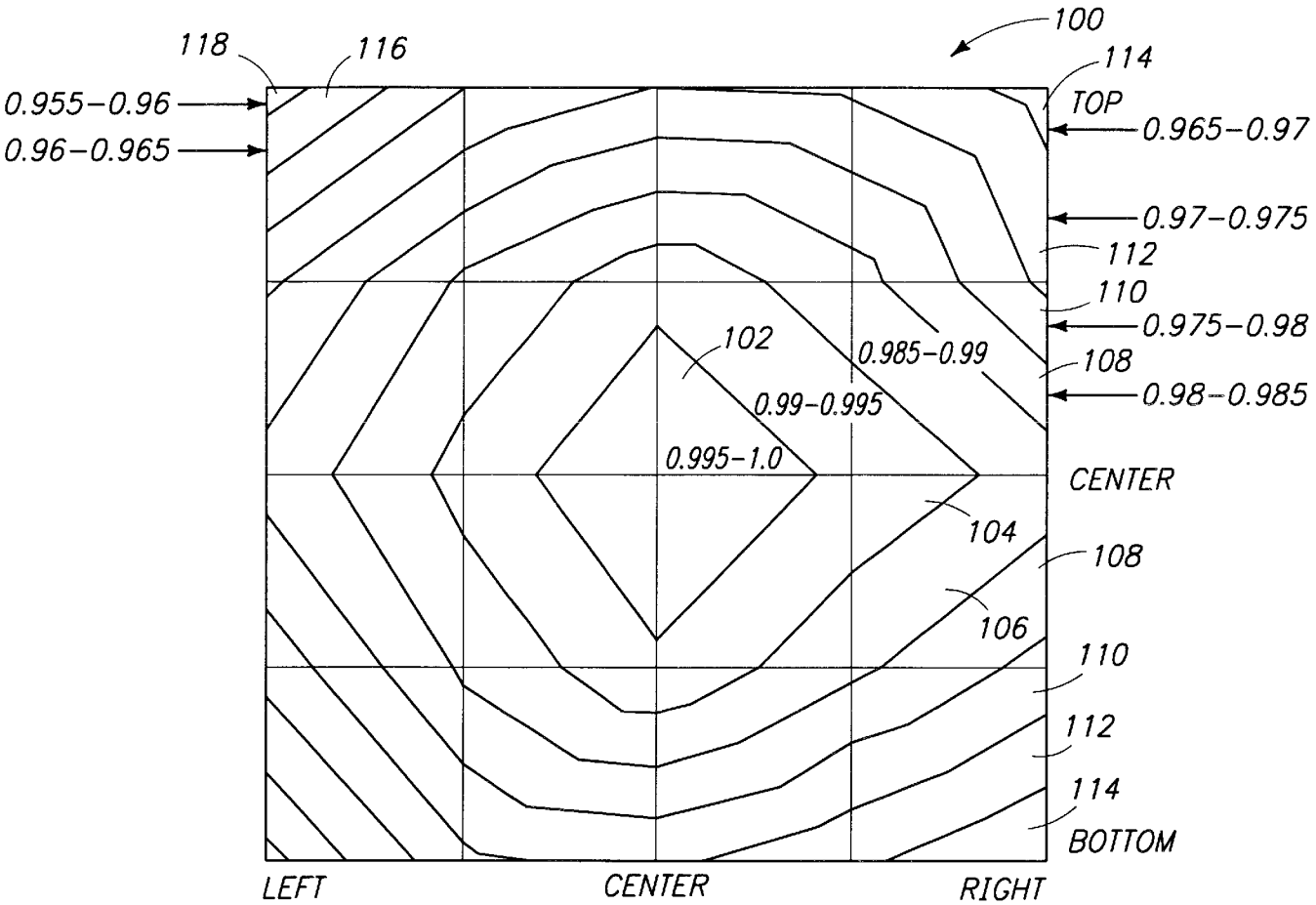
FIG. 2 illustrates the light intensity uniformity at a test plane without using the present invention.

FIG. 2 illustrates the light intensity uniformity at a test plane without using the present invention.

As described above, light intensity varies from hot spots in the middle of the test plane to cold spots near the fringes of the test plane. Test plane 100 has an area 102 near the center of test plane 100 that has a light intensity of 0.995–1.0. Surrounding area 102 is area 104 that has a light intensity of 0.99–0.995. Surrounding area 104 is area 106 that has a light intensity of 0.99–0.985. Surrounding area 106 is area 108 that has a light intensity of 0.98–0.985. Surrounding area 108 is area 110 that has a light intensity of 0.98–0.975. Surrounding area 110 is area 112 that has a light intensity of 0.97–0.975. Surrounding area 112 is area 114 that has a light intensity of 0.97–0.965. Surrounding area 114 is area 116 that has a light intensity of 0.96–0.965. Surrounding area 116 is area 118 that has a light intensity of 0.96–0.955.

Because of the difference in intensity between areas 102–114, the solar cells that will be illuminated by such an illumination intensity will receive different amounts of photonic stimulation, and, as such, will generate different amounts of voltage and current. The solar cells cannot be compensated by other means to determine whether the solar cell is acceptable for use on a spacecraft or if the solar cell needs to be replaced. Only with an illumination test can a solar cell be tested to see if the solar cell will produce the desired amounts of current and voltage.

The test plane 100 shown in FIG. 2 covers a ten foot by ten foot (10'×10') area, which can test an entire solar panel assembly. When the assembly is tested with such a large variation in illumination, the resultant power generated by the solar panel cannot be accurately guaranteed by the solar panel designer, because the difference in illumination across the panel creates an unknown for the designer. As such, the solar panel might have to be redesigned to be larger than required, or the solar panel designer may only state that the panel can produce a smaller amount of power, to ensure that the solar panels will produce adequate power to the spacecraft.

Figure 3:
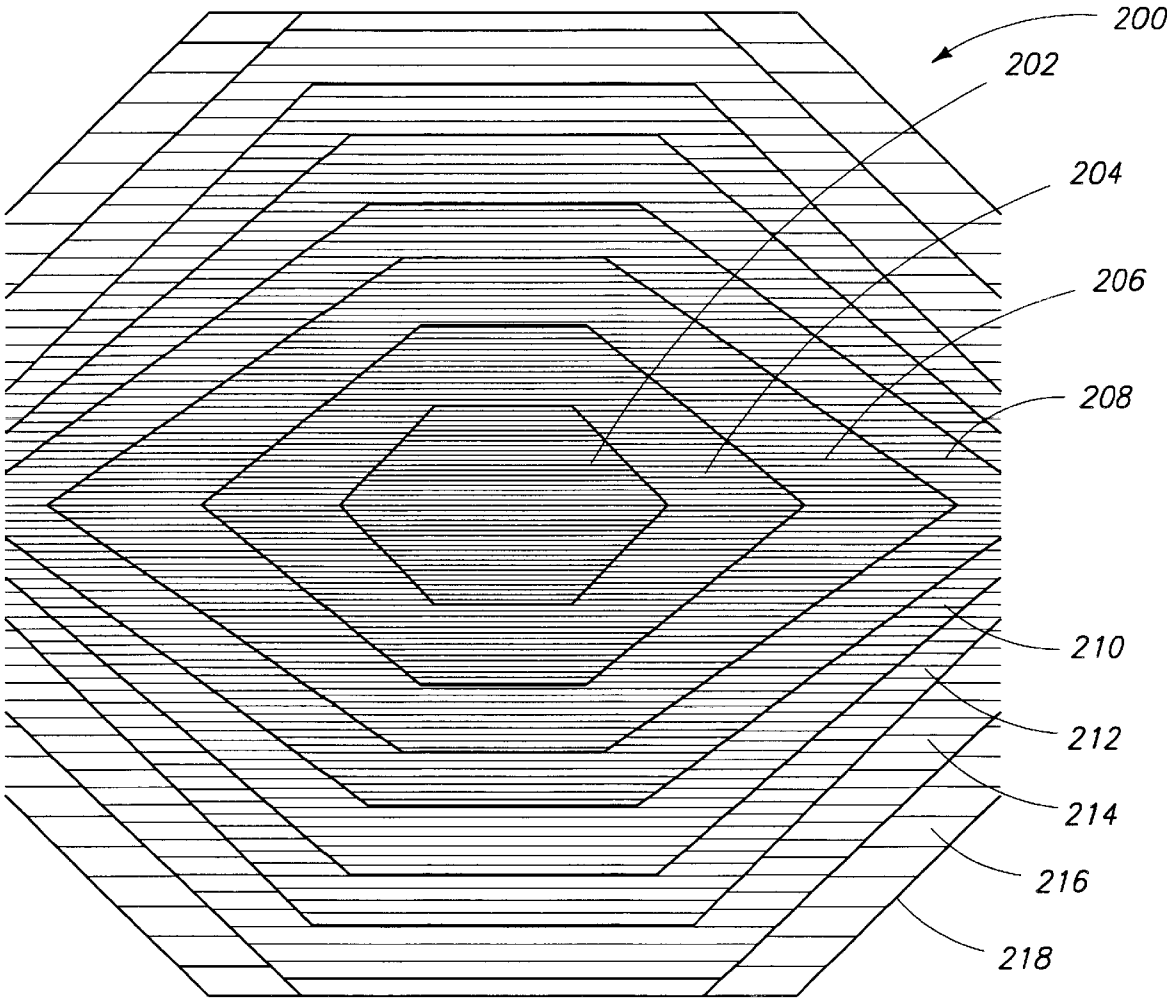
FIG. 3 illustrates the printed line pattern of the filter of the present invention.

FIG. 3 illustrates the printed line pattern of the filter of the present invention. To compensate for the variations in illumination shown in test plane 100, filter 200 is placed between the light source and the solar panel to selectively block some of the light emitted by the light source. Where the light is the brightest, e.g., area 102, area 202 is created with lines that are very close together, which blocks more light. Where the light is less intense, e.g., area 116, area 216 is created with lines farther apart, which blocks less light. Intermediate areas 204–214 are created with lines at various widths, to assist in the creation of a uniform plane of light intensity. As such, the lines selectively block the light to create a more uniform light at the test plane.

The lines of filter 200 are created by screenprinting techniques that create a black or opaque line on glass or otherwise transparent material. The black lines then serve to block the light from the light source, such that the light that passes through the transparent medium will be uniform in intensity. Although shown on FIG. 2 for ease of illustration, diagonal lines 218, which delineate the boundaries between areas 202–216, are not screenprinted on the filter 200. Lines 218 are shown for illustrative purposes only so that the boundary between areas 202–216 are easier to see.

Area 202 has lines that are spaced at typically 0.125", but can be spaced at a larger or smaller distance depending on the light source. Area 204 has lines that are spaced at typically 0.14", but can be spaced at a larger or smaller distance depending on the light source. Area 206 has lines that are spaced at typically 0.165", but can be spaced at a larger or smaller distance depending on the light source. Area 208 has lines that are spaced at typically 0.195", but can be spaced at a larger or smaller distance depending on the light source. Area 210 has lines that are spaced at typically 0.24", but can be spaced at a larger or smaller distance depending on the light source. Area 212 has lines that are spaced at typically 0.31", but can be spaced at a larger or smaller distance depending on the light source. Area 214 has lines that are spaced at typically 0.44", but can be spaced at a larger or smaller distance depending on the light source. Area 216 has lines that are spaced at typically 0.75", but can be spaced at a larger or smaller distance depending on the light source.

Further, although the lines are shown as being similar in width, the line thickness may be varied from area 202–216 to area 202–216 to accommodate test plane size variations or other test setup variations. Typically, the line widths are 0.009 inches. The filter 200 distance from the light source can also be varied or focused to further adjust the illumination intensity uniformity.

Figure 4:
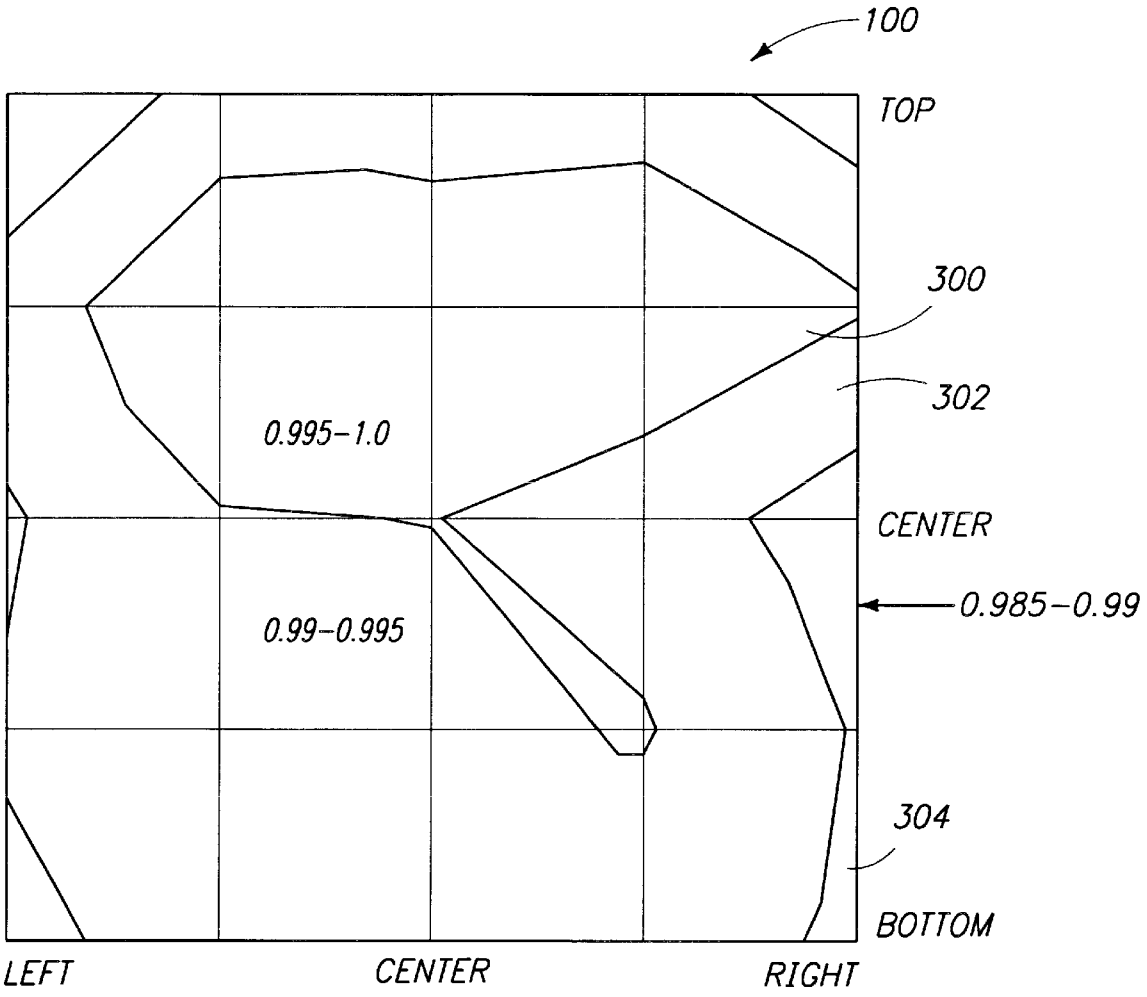
FIG. 4 illustrates the light intensity uniformity at a test plane with the filter of the present invention.

FIG. 4 illustrates the light intensity uniformity at a test plane with the filter of the present invention.

Instead of areas 102–118, only three areas 300–304 exist when the filter 200 of the present invention is placed between the light source and the test plane 100. Area 300, which has an intensity of 0.995–1.0, is now larger than the comparable area 102 of FIG. 2. Area 302, which has an intensity of 0.99–0.995, is now larger than the comparable area 104 of FIG. 2. Finally, the variance across the entire test plane 100 is now only 0.985–1.0, whereas without the filter 200 of the present invention, the variance was from 0.955–1.0. This increase of 0.03 in the variance leads to more repeatable testing and more accurate characterization of solar panels that are tested in a facility using the present invention. Further, the reduction in light intensity variation reduces the testing uncertainty of a solar panel under test.

Figure 5:
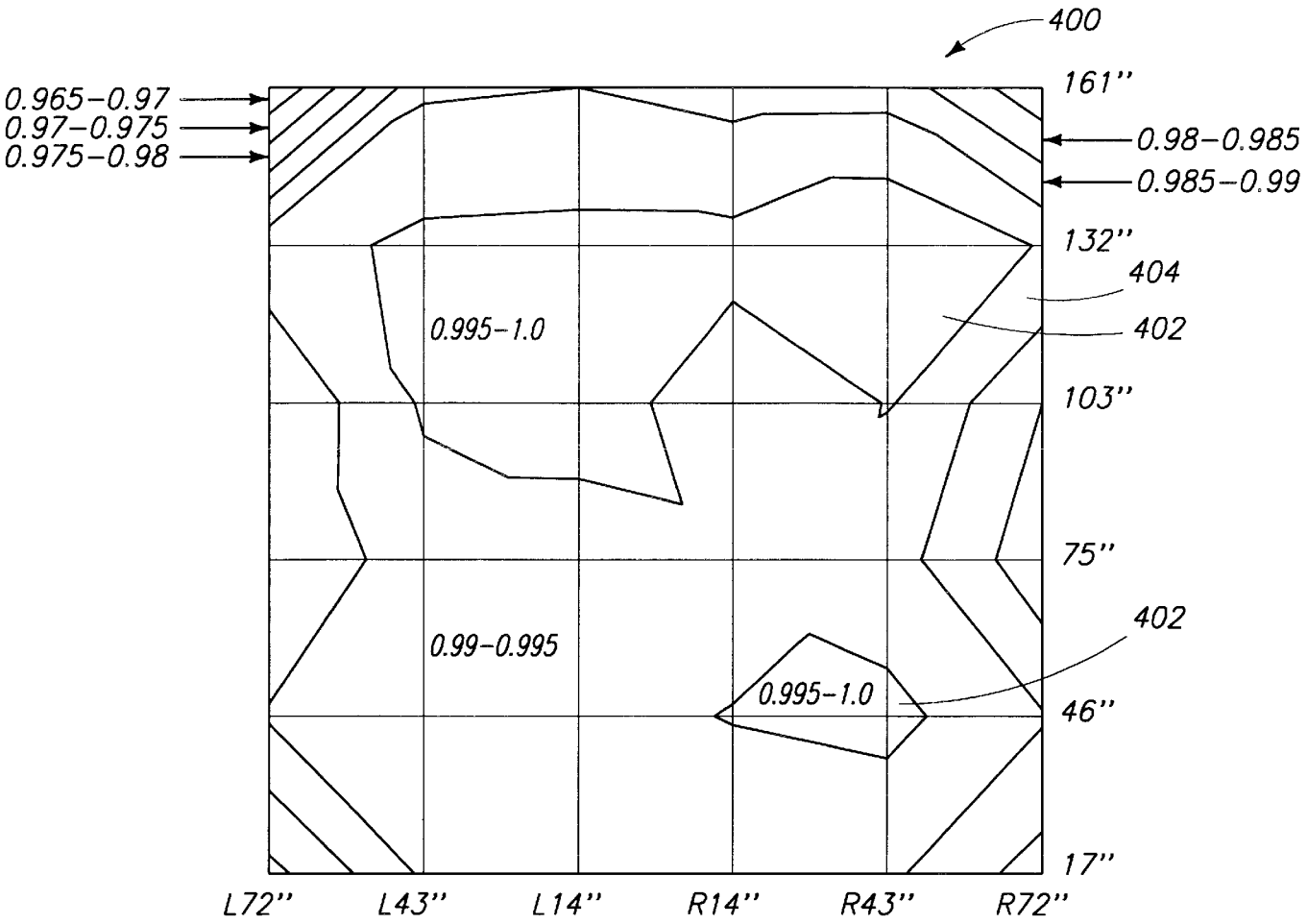
FIG. 5 illustrates the increased test plane size available using the filter of the present invention.

FIG. 5 illustrates the increased test plane size available using the filter of the present invention.

Test plane 400 can now be increased to a twelve foot by twelve foot (12'×12') area to test larger solar panels by using the filter of the present invention. The areas 402 and 404 cover a large majority of the test plane 400 surface, and the variance across the test plane 400 is only 0.965–1.0. The filter 200 allows the test plane to increase in size without sacrificing much in the way of uniformity.

This increase in test plane 400 size, e.g., from 10'×10' to 12'×12', allows for reduced test time to accommodate larger solar panels, eliminates the need to reposition the solar panels for each circuit to assure adequate uniformity, and increases test result reliability and repeatability.

Process Chart

Figure 6:
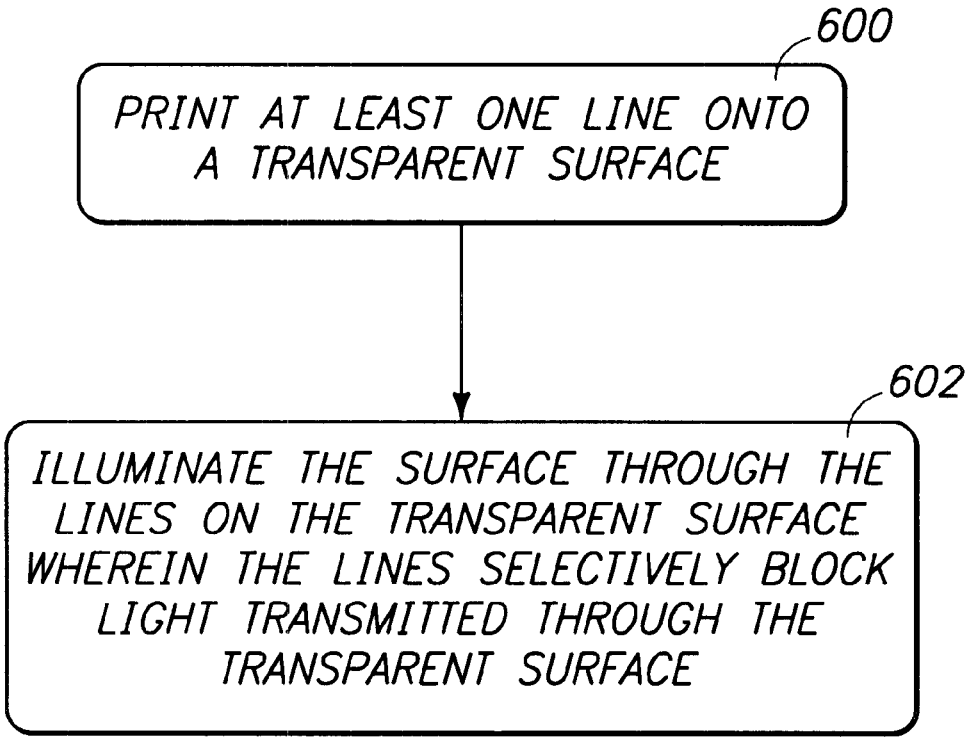
FIG. 6 is a flow chart showing the operations used to practice one embodiment of the present invention.

FIG. 6 is a flow chart showing the operations used to practice one embodiment of the present invention.

Block 600 represents performing the step of printing at least one line onto a transparent surface.

Block 602 represents performing the step of illuminating the surface through the lines on the transparent surface, wherein the lines selectively block light transmitted through the transparent surface.

Conclusion

This concludes the description of the preferred embodiments of the present invention. In summary, the present invention describes an apparatus and method for making a filter for providing uniform intensity light.

Although described with respect to a LAPSS, the present invention can also be used to provide uniform intensity to individual solar cells by creating a thin film with a printed pattern. Further, the present invention can be used for ultraviolet or infrared light transmission. The present invention can also use other materials for the substrate containing the screenprinted lines, such as mylar, plastic, silicon, germanium, gallium arsenide, or other materials that are transparent at a wavelength region of interest.

Although described with respect to screenprinting, other methods of printing the lines onto a transparent medium can be used, such as lithography, photolithography, direct writing, laser printing, or other methods.

The foregoing description of the preferred embodiment of the invention has been presented for the purposes of illustration and description. It is not intended to be exhaustive or to limit the invention to the precise form disclosed. Many modifications and variations are possible in light of the above teaching. For example, the process can be repeated to create a two layer thin film device if desired. It is intended that the scope of the invention be limited not by this detailed description, but rather by the claims appended hereto.

What is claimed is:

1. A filter for providing uniform intensity light, comprising:

a transparent sheet, substantially transparent at a wavelength region of interest; and a line pattern, printed on a first side of the transparent sheet, the line pattern configured to selectively block light having a non-uniform intensity from being transmitted through the transparent sheet to provide light having a substantially uniform intensity.

2. The filter of claim 1, wherein the transparent sheet is made of a material selected from a group comprising glass, mylar, silicon, germanium, and gallium arsenide.

3. The filter of claim 1, wherein the line pattern is generated based on an illumination intensity of the light source.

4. The filter of claim 1, wherein the line pattern is generated by screenprinting the line pattern onto the transparent sheet.

5. The filter of claim 1, comprising multiple transparent sheets, each transparent sheet printed with line patterns that collectively selectively block light having a non-uniform intensity from being transmitted through the transparent sheet to provide the light having the substantially uniform intensity.

6. A method for providing uniform intensity light at a surface, comprising the steps of:

illuminating the surface through the lines on a transparent surface with a light having non-uniform intensity; and selectively blocking non-uniformly high intensity light transmitted through the transparent surface with at least one line printed on the transparent surface.

7. The method of claim 6, wherein the transparent sheet is made of a material selected from a group comprising glass, mylar, silicon, germanium, and gallium arsenide.

8. The method of claim 6, wherein the line pattern is generated based on the illumination intensity of the light source.

9. The method of claim 6, wherein the line pattern is generated by screenprinting the line pattern onto the transparent sheet.

10. The method of claim 6, wherein the non-uniform high intensity light is selectively blocked with multiple transparent sheets each multiple transparent sheet printed with line patterns.

11. The method of claim 6, further comprising the step of printing at least one line onto a transparent surface.

12. A system for providing uniform intensity light at a surface, comprising:

a light source, for illuminating a surface with light; and a filter, disposed between the light source and the surface, the filter having at least one line printed onto a first surface of the filter, wherein the line selectively blocks a portion of light having a non-uniform intensity to provide a light having a substantially uniform intensity to the surface.

13. The system of claim 12, wherein the filter is made of a material selected from a group comprising glass, mylar, silicon, germanium, and gallium arsenide.

14. The system of claim 12, wherein the line comprises a pattern of lines generated based on the illumination intensity of the light source.

15. The system of claim 12, wherein the line is generated by screenprinting the line onto the transparent sheet.

16. The system of claim 12, wherein the filter comprises multiple filters, each filter printed with at least one line to provide uniform light intensity.

* * * * *